United States Patent [19]

DiTullio

[11] 4,453,549

[45] Jun. 12, 1984

[54] BRASSIERE

[75] Inventor: Flavia DiTullio, New York, N.Y.

[73] Assignee: Consolidated Foods Corporation, Winston-Salem, N.C.

[21] Appl. No.: 569,410

[22] Filed: Jan. 9, 1984

[51] Int. Cl.[3] ..... A41C 3/00

[52] U.S. Cl. ..... 128/498

[58] Field of Search ..... 128/498, 485, 484, 491, 128/492, 494

[56] References Cited

U.S. PATENT DOCUMENTS

| | | | |
|---|---|---|---|
| 1,748,715 | 2/1930 | Imershein | 128/485 |
| 2,623,212 | 12/1952 | Halper | 128/484 |
| 3,353,540 | 11/1967 | Erteszek | 128/489 |

*Primary Examiner*—Doris L. Troutman

*Attorney, Agent, or Firm*—Charles Y. Lackey; William S. Burden

[57] ABSTRACT

A brassiere including a pair of bust supporting cups having an outer panel means and an inner segment, an underbust band assembly, a pair of back band portions, and a pair of shoulder straps connected to the cups and to the back band portions. The generally crescent-shaped inner segments extend from the top of each cup to the lower central area of the cup such that when strain is exerted from the force of the breasts, the inner segments are activated and function to reshape the breast and avoid distorting and misshaping the outer cup panel means.

7 Claims, 3 Drawing Figures

BRASSIERE

BRIEF SUMMARY AND OBJECTS OF THE INVENTION

This invention relates to brassieres employing in each bust cup an arcuate segment in a selected location which functions to reshape a defectively shaped breast while avoid wrinkling and misshaping the outer cup fabric panels. Preferably, each arcuate segment is crescent-shaped having a convex marginal edge stitched to other fabric and a free or floating concave marginal edge. In a preferred embodiment, the segments are crescent-shaped and extend from a point adjacent the top of a cup, adjacent the juncture of the cup with a shoulder strap, downwardly along the outside edge of the cup and to a point adjacent the central bottom portion of the cup.

A primary object of the invention is a brassiere construction having a simplified breast-supporting and reshaping means.

Another object of the invention is the provision of a new and improved brassiere which is efficient in use and of durable construction.

A further object of the invention is a brassiere having a composite cup construction including an outer fabric construction and an inner stress distributing means.

These and other objects and advantages of the invention will become apparent when considered in connection with the accompanying drawings.

BRIEF DESCRIPTION OF A PREFERRED EMBODIMENT

Figure 1:
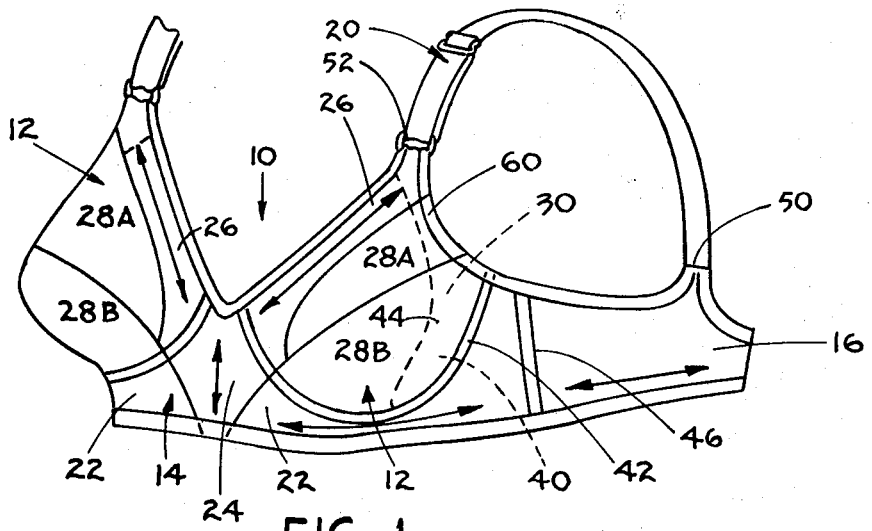
FIG. 1 is a schematic front perspective view of a brassiere embodying the present invention.
Figure 2:
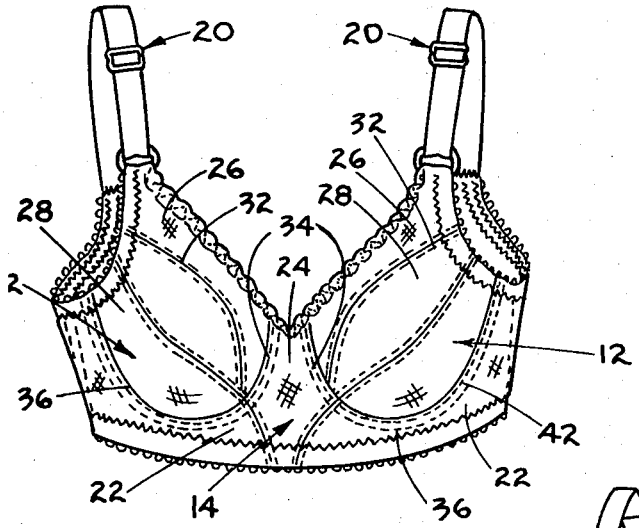
FIG. 2 is a front elevational view of a brassiere embodying the invention.
Figure 3:
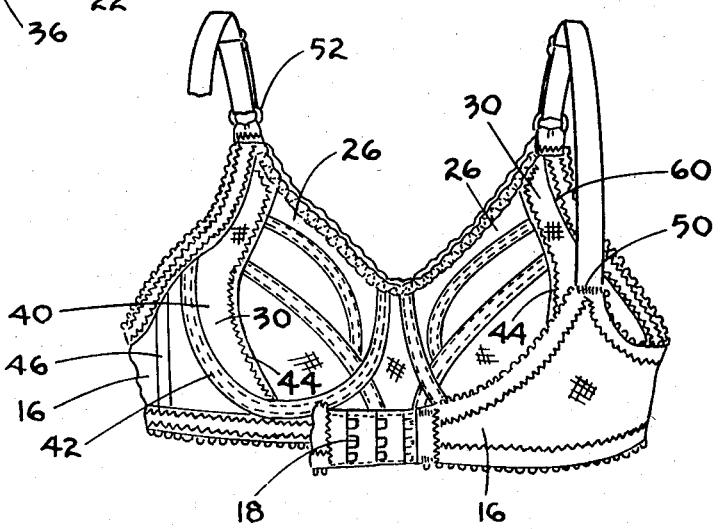
FIG. 3 is a rear elevational view, with portions broken away, showing the inside of the brassiere.

Referring to the drawing, the brassiere 10, constructed in accordance with the principles of the present invention, includes a pair of bust cups 12 secured together by means of an underbust band assembly 14, a pair of back band portions 16, an adjustable fastener assembly 18, a portion of which is shown by FIG. 3, for releasably connecting the back band portions together, and a pair of shoulder strap assemblies 20.

The underbust band assembly 14 comprises front panels 22, 22, extending beneath and to the outer sides of the cups, and a central front panel 24. The panels 22 and 24 may be formed of various materials including stretch fabric or elastic power net fabric.

Each cup 12 may be fabricated of one or more outer panels, and preferably includes an upper panel 26, panel 28 and an inner segment 30. The panels 26 and 28 are secured together by stitching along seams 32 and panels 26 are secured to the band assembly 14 along seam lines 34. The outer panel 28, which may consist of two portions 28A and 28B, is stitched to the band assembly 14 along seam lines 36.

Each cup inner segment 30 comprises an arcuate member which, in a preferred embodiment, is generally crescent-shaped and extends from a location at the top of the cup, adjacent the juncture of the cup with a shoulder strap, downwardly along the outer portion of the cup and terminates generally at the lower, central portion of the cup. The outer, convex, marginal edge 40 of segment 30 is stitched to the outer panel 28 and to the underbust band assembly 14 along line 42 and to the binding 60, and the concave inner, marginal edge 44 is not secured to panel 28 but is free to move relative thereto. The segment 30 may be of various materials, and in a preferred embodiment is of elastic, power net fabric.

The segment 30 has substantially less fabric than the panel 28 of cup 12 such that the strain exerted from the force of the breast activates the segment which distributes stress along the cup while avoiding distortion of the fabric of panel 28. When the wearer has defectively shaped breasts, the segments 30 function to reshape the breasts while avoiding wrinkling or misshaping the cup outer fabric. The crescent-shaped panels serve to distribute stress evenly along the cups when actuated by the pull of the straps 20 which, in effect, are secured to the segments.

The back band portions 16 may be of substantially any desired construction, and preferably are of elastic fabric having a rapid rate of recovery at least in the horizontal or body encircling direction. Portions 16 may be secured to assembly 14 by stitching along seam lines 46.

The shoulder strap assemblies 20 include adjustable straps 48 secured to upper edges of back band portions 16, as at 50, and also secured to the upper portions of the bust cups 12, as at 52.

Thus, it will be seen that the present invention provides a brassiere wherein each cup includes a substantially undetectable, arcuate inner panel which serves to distribute stress evenly along the cup and reshape the breast.

What is claimed is:

1. In a brassiere construction, a pair of breast receiving cups, a pair of back band portions, means joining said cups and said back band portions, and a pair of shoulder strap means, each shoulder strap means being connected to an adjacent breast receiving cup and to an adjacent back band portion, each of said breast-receiving cups including an outer fabric panel means and an inner fabric segment selectively secured to said outer fabric panel means, said inner segment extending downwardly from the juncture of the cup with a shoulder strap means and about the outer side portions of said fabric panel means, said segment serving to distribute stress equally along the cup for reshaping the breast while avoiding distortion and misshaping of said outer fabric panel means.

2. In a brassiere construction as recited in claim 1, said inner fabric segment having at least a portion of an outer marginal edge secured to said outer fabric panel means, and an inner marginal edge free to move relative to said outer fabric panel means.

3. In a brassiere construction as recited in claim 2, said inner segment being crescent-shaped.

4. In a brassiere construction as recited in claim 2, at least a portion of said outer fabric panel means being formed of elastic fabric.

5. In a brassiere construction as recited in claim 4, said outer fabric panel means including upper and lower sections, said upper section being of elastic fabric.

6. In a brassiere construction as recited in claim 1, said inner segment being of elastic power net fabric.

7. In a brassiere construction as recited in claim 6, said inner segment being arcuate and having a free concave marginal edge and a convex marginal edge, at least a portion of said convex edge being secured to said outer fabric panel means.

* * * * *